US010557270B2

(12) United States Patent
Groeneweg

(10) Patent No.: US 10,557,270 B2
(45) Date of Patent: Feb. 11, 2020

(54) RAILING SYSTEM

(71) Applicant: Q-RAILING EUROPE GMBH & CO. KG, Emmerich am Rhein (DE)

(72) Inventor: Frans Groeneweg, Rees (DE)

(73) Assignee: Q-Railing Europe GMBH & CO. Kg, Emmerich am Rhein ( * ) Notice: Subject to any disclaimer, the term of this patent is extended or adjusted under 35 U.S.C. 154(b) by 259 days.

(21) Appl. No.: 15/536,342

(22) PCT Filed: Dec. 15, 2015

(86) PCT No.: PCT/DE2015/100535
§ 371 (c)(1),
(2) Date: Jun. 15, 2017

(87) PCT Pub. No.: WO2016/095906
PCT Pub. Date: Jun. 23, 2016

(65) Prior Publication Data

US 2017/0370108 A1 Dec. 28, 2017

(30) Foreign Application Priority Data

Dec. 15, 2014 (DE) ..... 20 2014 106 053 U

(51) Int. Cl.
*E04F 11/18* (2006.01)
*E06B 5/12* (2006.01)
*E04H 9/06* (2006.01)

(52) U.S. Cl.
CPC ..... *E04F 11/1836* (2013.01); *E04F 11/18* (2013.01); *E04F 11/1853* (2013.01); *E06B 5/12* (2013.01); *E04F 11/1851* (2013.01); *E04F 2011/1868* (2013.01); *E04H 9/06* (2013.01); *Y10S 403/10* (2013.01); *Y10T 403/54* (2015.01)

(58) Field of Classification Search
CPC ... E04F 11/1836; E04F 11/1853; E04F 11/18; E04F 2011/1868; E04F 11/1851; E06F 5/12; E04H 9/06; Y10S 403/10; Y10T 403/54
USPC ..... 256/24; 52/169.1–169.4
See application file for complete search history.

(56) References Cited

U.S. PATENT DOCUMENTS 4,364,546 A * 12/1982 Lyman ..... E04H 17/165 256/24
4,690,383 A * 9/1987 Batcheller ..... E04F 11/1853 256/24
7,866,636 B1 1/2011 Hansen
2001/0025953 A1 10/2001 Shepherd
2006/0284154 A1 12/2006 Sprague
2007/0163189 A1 7/2007 Venegas

FOREIGN PATENT DOCUMENTS

DE 2657600 A1 6/1978

* cited by examiner

*Primary Examiner* — Greg Binda

(57) ABSTRACT

In a railing system comprising a railing panel frontage which extends continuously along the course of the railing and consists of a plurality of mutually adjacent railing panels, in order to increase an additional resistance and security against destruction, an additional securing element, which, given a properly erected railing, extends between a handrail profile, resting on the railing panels, and a structural body or a holding profile disposed on the structural body and connects the handrail profile to the structural body or the holding profile, is provided.

18 Claims, 2 Drawing Sheets

RAILING SYSTEM

CROSS REFERENCE TO RELATED APPLICATIONS

This application is a national stage application under 35 U.S.C. 371 of PCT Application No. PCT/DE2015/100535 having an international filing date 15 Dec. 2015, which PCT application claimed the benefit of German Patent Application No. 20 2014 106053.7 filed 15 Dec. 2014, the entire disclosure of each of which are hereby incorporated herein by reference.

TECHNICAL FIELD

The invention relates to a railing system comprising a railing panel frontage which extends continuously along the course of the railing and consists of a plurality of mutually adjacent (all-glass) railing panels, which, if the railing is properly erected, are vertically embedded with their lower marginal region in a holding profile fastened to a structural body, or in a receptacle which has been placed into a structural body and on the upper marginal region of which is mounted a handrail profile.

INTRODUCTION

In recent times, railings in which use is made of all-glass railing panels which are broadly free-standing and are inserted only with their lower margin in a holding profile anchored to a structural element, so that they—apart from the few-millimeters-wide gap between adjacent glass panels—form a visually appealing continuous glass frontage, have increasingly been employed.

In (all-glass) railings of this type, which extend at ground level, not only must the holding profile be securely anchored to the structure. The heavy glass panels themselves must be fixedly held in the holding profile and can absorb forces sufficiently to be able to serve as a reliable fall protection and to also be able to support a substantial number of persons leaning against the railing. The forces which act on the holding profile via the glass panel, when, for example, one or more persons lean against the railing, are considerable due to the leverage ratios. The glass panes preferredly used as railing panels are, depending on the application, are of very heavy and thick configuration, as well as of multi-ply configuration in the form of composite glass panes.

At the same time, all-glass railings of this type are regarded as design objects and high requirements are imposed on the visual appeal and the quality impression of such a railing. This applies, on the one hand, to the requirement to employ mutually adjacent railing panels in an offset-free manner so as not to create visual breaks in the railing panel frontage. On the other hand, the visually appealing impression of the continuous railing panel frontage should, as far as possible, not be interrupted by additional railing system components which project from the panel plane defined by the railing panel frontage.

Since railings of this type are being used more and more frequently also within the public sector—think here, for example, of airports, railways stations or sports venues—further requirements are increasingly being imposed on such railings, which requirements transcend the requirements already described. One requirement on which attention has recently been focused is an advantageous behavior and a raised resistance with respect to detonations of explosive devices. It is here desirable that the railing system is of sufficiently stable construction that it is affected as little as possible by the impact of a detonation. Should the railing, however, be destroyed by a detonation blast wave or be torn out of its anchorage, it is important to avoid a situation in which the railing, as a the result of a detonation, breaks up into a large number of individual parts, which, as flying individual parts, can inflict additional damage.

SUMMARY

The object of the invention is therefore to provide a railing system which—apart from the gap between adjacent glass panels and the use of a holding profile which extends at ground level—enables the installation of a continuous railing panel frontage extending at ground level and makes do with slimly dimensioned railing system components in order to ensure an appealing appearance, yet all the same provides additional resistance and security in the event of the detonation of an explosive device in its vicinity. Moreover, the railing system, despite the additional requirements, should be able to be constructed with simple means and with minimal cost and effort.

For the achievement of this object, the invention provides a railing system of the type stated in the introduction in which is provided an additional securing element, which extends between handrail profile and structural body or between handrail profile and holding profile and which connects the handrail profile to the structural body or the holding profile.

By virtue of this design, it is ensured that, in the event of a detonation, the structural parts of the railing, in particular the railing panels which provide a fundamental target for a blast wave, are additionally secured by the securing element disposed between handrail and holding profile or structural body. Both the structural body or the holding profile on the one hand, and the handrail profile on the other side, enclasp the railing panels in a positive-locking manner on the top side and on the bottom side through the configuration of a receiving groove in the holding profile or structural body, on the one hand, and a bordering groove in the holding profile, on the other hand. Besides the enclaspment of the railing panels, the securing element also secures the handrail profile mounted onto the top side of the railing panels, so that it cannot detach itself from the railing panels and, after a detonation, fly around as an individual structural part.

For further understanding of the invention, it should be explained that the structural body is formed by a part of the structure which receives the railing panels or is anchored to the holding profile accommodating the railing panels, thus, in particular, by a floor or the end face or marginal region of a balustrade or balcony. The receptacle for the railing panels can here be placed directly in the structural body, in particular in the form of a receiving groove which extends along the railing and into which the railing panels can be directly embedded and cast or in which they are braced. Preferredly, it is provided, however, that a holding profile is first fastened to the structural body, in which the railing panels are then fixed.

The securing element is preferredly formed by a high-strength cable, in particular a steel cable, or a high-strength rod or a high-strength tube, in particular a steel rod or a steel tube. Besides the use of steel, other materials with high tensile strength can also, of course, be considered, for instance aramid or carbon fibers. The advantages of such securing element is in particular that, due to their elongately narrow dimensions, they can be accommodated within the gap between the individual railing panels.

For the connection of the securing element to the handrail profile, the securing element preferredly engages positively in the handrail profile. In particular, bolted joints, or tie rods which can be introduced via an opening provided in the handrail tube and which back-grip the handrail tube on the inside, can be used. In particular where a cable and a handrail tube, having an inner cavity, as the handrail profile, are used, it is likewise conceivable to guide the cable at a first point, in particular in the region of a first gap present between the railing panels, into the interior of the handrail tube, and to guide it at a second point, in particular in the region of a second gap adjacent to the first gap, back out of the handrail tube, in which case both ends of the cable are connected at the respectively other point to the structural body or the holding profile.

For the connection of the securing element to the structural body, it can be provided that that end of the securing element which is facing toward the structural body is anchored directly in the structural body.

Preferredly, however, it is provided that that end of the securing element which is facing toward the structural body has a securing anchor, which cooperates with the holding profile. The securing anchor preferredly engages positively in the holding profile.

To this effect, in the holding profile can be retro fitted a separate anchoring point, which, for the purpose of positive engagement of the securing anchor in the holding profile, forms an undercut 225 in a material region that forms the holding profile. "Retrofitted" means in this context that the anchoring points are introduced into the material of the holding profile only after the original creation of the holding profile—the holding profiles generally being constituted by extruded metal profiles, for instance by a material removal by means of milling and/or drilling, which takes place after the extrusion.

Such an undercut 225 can be formed, for instance, by a passage opening 205 which is made in the holding profile material and through which the securing element can be guided in order to effectively back-grip the holding profile at the anchoring point in the direction of load. Such a passage opening, which is preferredly designed stepped in the direction of load, can be provided in a vertically oriented side branch of the holding profile, which holding profile preferredly forms a U-shaped receiving channel, thereby enabling better accessibility to the lower end of the securing element even after the installation of the holding profile on the structural body and the insertion of the railing panels. However, it is also conceivable to provide the passage opening in the lower, horizontal branch, which faces directly toward the structure, of a holding profile of U-shaped cross section.

In association with the anchorage of the securing element to the holding profile, it can also be provided that the holding profile or receptacle in the body of the structure, and the securing anchor, cooperate via an anchor bridge. If the securing anchor has an anchor bridge which, due to its effective width in the direction of load of the securing element, is capable of wedging in a positive-locking manner within the holding profile, then said anchor bridge in particular secures the securing element in the holding profile. Such an anchor bridge can be introduced into the holding profile or the structure receptacle in a first orientation, in particular in a direction opposite to the direction of load, and in a second orientation, within the holding profile or the structure receptacle, can back-grip a material portion 229 which forms an undercut 225 acting in the direction of load of the securing element. The use of an anchor bridge as part of the securing anchor has in particular the advantage that this can back-grip a material portion which has already been provided on the holding profile during the original creation of the holding profile. The subsequent introduction of an undercut by a production step downstream of the original manufacturing process, in particular, therefore, the extrusion, is not necessary. Such a design comprising an anchor bridge can however be considered, of course, also in respect of anchoring points which have been retrofitted into the holding profile.

In order that the securing element is guided in broadly centered and parallel arrangement to the railing panel surfaces within a gap existing between two adjacent railing panels, a centering element, through which the securing element is guided, can be provided. The centering element can be formed by a centering insert which is insertable into the receiving channel, in particular by a centering insert which extends between the mutually opposite inner walls of a U-shaped receiving channel and which can preferredly be braced between these two inner walls. Depending on the design of the previously described anchor bridge and the proper positioning thereof within the railing panel receptacle, said anchor bridge can also, however, form the centering element.

In order that the securing element, in particular when it is formed by a cable which in a load situation is subjected to tensile stress, does not "hang" slackly and therefore in partly undefined orientation between the railing panels, a pretensioning mechanism, which keeps the securing element tensioned, can be provided. Such a pretensioning mechanism can in particular have a spring mechanism which ensures the pretension. Additionally or alternatively hereto, a pretensioning mechanism comprising control elements, in particular pretensioning screws, by means of which the securing element can be tensioned, can be provided.

As the pretensioning mechanism, consideration can be given, in particular, to a control element which acts on the anchor bridge and which, given a properly erected railing, is preferredly accessible from outside. In one of the vertically oriented branches of a U-shaped receiving profile can be provided an adjusting screw, which acts on the anchor bridge positioned within the receiving groove.

DETAILED DESCRIPTION

Figure 1:
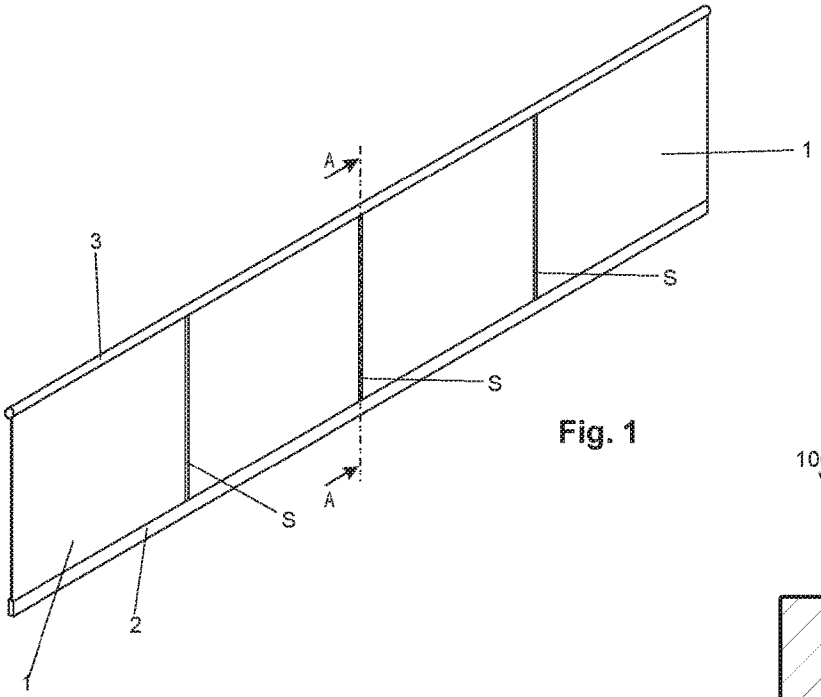
FIG. 1 shows a railing system comprising a railing panel frontage which extends continuously along the course of the railing.

FIG. 1 shows a railing in which a plurality of glass railing panels 1, arranged side by side, form a railing infill. The railing panels form a continuous glass surface, which is interrupted at regular intervals, for just a few millimeters, only by gaps S which necessarily exist between two adjacent railing panels. The railing panels 1 stand at ground level in a holding profile 2, which is configured as an upright, U-shaped bottom profile 2, which via an anchorage is fixedly anchored to a structure, for example a floor surface. The railing panels are firmly fixed in the bottom profile 2 in a manner which is known per se and are thus securely supported on the structure with the interposition of the bottom profile 2.

The bottom profile 2, which is preferredly an extruded (solid) aluminum profile, has a U-shaped receiving channel, which extends along the length of the railing and is open on the top side, and which forms the railing panel receptacle in which the railing panel 1 is inserted with its lower margin.

Figure 2:
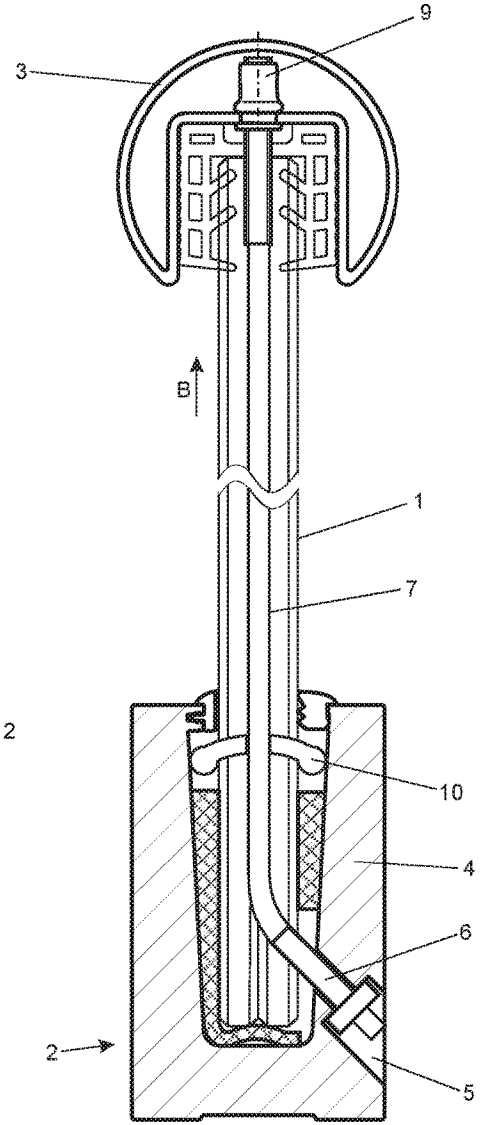
FIG. 2 shows a first possible sectional view of a first embodiment along the section A-A indicated in FIG. 1.
Figure 3:
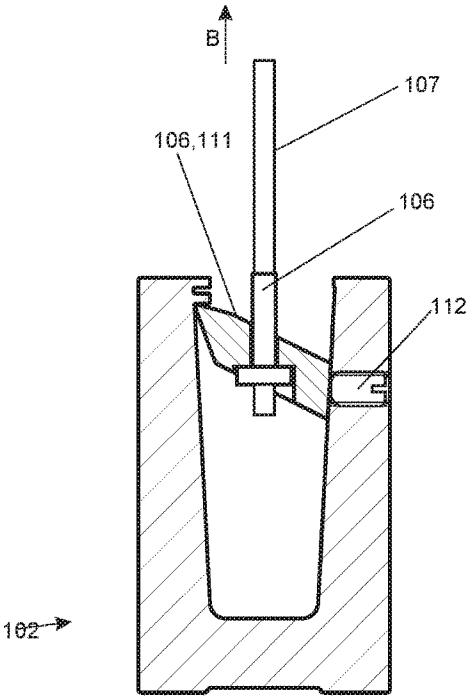
FIG. 3 shows a second possible sectional view, alternative to the embodiment of FIG. 2, of a second embodiment along the section A-A indicated in FIG. 1.

Onto the upper end face of the railing panels 1 is mounted a continuous handrail profile 3, which extends preferredly over individual gaps S and which, as can be seen below in FIG. 2 and FIG. 3, is preferredly formed by a slotted tube.

FIG. 2 illustrates a first embodiment of the invention. In a side branch 4 of the preferredly solid bottom profile 2, a stepped passage opening 5 is made by means of a bore, in which a securing anchor 6 of a securing element, which latter has, besides the securing anchor 6, a steel cable 7, engages.

The securing anchor 6 can be formed by a steel cable holding apparatus, as is disclosed, for instance, German Utility Model Specification DE 20 2013 101 806.6 U1, the content of which, insofar as sensibly applicable for the present invention, is made the subject of this Application. Of course, other types of a securing anchor which are capable of effectively absorbing a sudden, jerky tensile load upon the wire cable 7 and of supporting this same on the holding profile 2 can also be considered.

That end of the wire cable 7 which is facing away from the bottom profile 2 engages with an engagement part positively in a handrail profile 3, which at the upper edge of the railing panel 1 is mounted onto the railing panel 1 on the end face and embraces the railing panel 1 on both sides with a bordering groove formed by the handrail profile 3. In FIG. 2 is shown, by way of example, the use of a blind rivet nut 9, in which a thread disposed on said end of the wire cable 7 engages.

By way of example, with reference to the embodiment represented in FIG. 2, it should be made clear that the securing anchor which in FIG. 2 cooperates with the bottom profile can also be used as the engagement part engaging positively in the handrail profile, and the thread/blind rivet nut pairing can also be used as the securing anchor cooperating with the bottom profile.

Also provided in the bottom profile 2 is a centering element in the form of a centering aid 10, through which the wire cable 7 is guided. Preferredly, the centering aid is configured in the form of a bridge-like clasp extending over the width of the receiving channel. It is thereby ensured that the securing element, in particular, therefore, the steel cable, is guided in centered arrangement in the gap S between the adjacent railing panels and does not protrude laterally from the railing panel plane. A positioning of the securing element which is possibly detrimental to the visual appearance can in this way be avoided, in particular in cases in which the attachment of the securing element to the railing system does not by itself ensure a centering.

From FIG. 2 can be seen that the steel cable 7 acting as the securing element connects the holding profile 2 and the handrail profile 3 mounted onto the top edge of the railing panels 1 one to the other. The railing components handrail tube and bottom profile, which embrace the railing panels 1 on the top and bottom side, enclose the railing panels effectively between them, enclasping the end faces of the railing panels respectively on both sides. The handrail profile 3 is held on the holding profile 2 by means of the securing element (steel cable 7). The mutual separation of the individual components of the railing system is made considerably more difficult by the blast wave of a detonation.

FIG. 3, in which, for the sake of clarity, the handrail profile and the railing panels are not shown, shows alternatively to the embodiment represented in FIG. 2 a version of the invention in which—unlike in FIG. 2—no passage opening for a securing anchor is provided in the material of the bottom profile. Rather, a securing anchor having an anchor bridge 111 which is wedged within the receiving groove of the holding profile is employed. The effective width of the securing element is here larger than that effective width of the receiving channel which is present at the anchoring point. In the proper installation position, the anchor bridge 111 back-grips on a first side a material region, projecting inward within the receiving channel, of the holding profile 102. With the other, second side, the anchor bridge 111 is supported against the inner wall of the bottom profile 2. When the securing element is subjected to load in the direction of load B, the anchor bridge 111 is thus effectively wedged within the receiving groove. The anchor bridge 111 has a receptacle for a holding apparatus 6, which receptacle is preferredly centered relative to the railing panel plane.

FIG. 3 further illustrates, by way of example, the use of an optional pretensioning device in the form of a pretensioning screw 112. In the vertically oriented side branch 104 of the U-shaped receiving channel is provided a pretensioning screw 112, which, by being increasingly screwed down against the second side of the anchor bridge 111, ensures that the second side pivots downward, whereby a stretching or pretensioning of the securing element 107 is realized.

Figure 4:
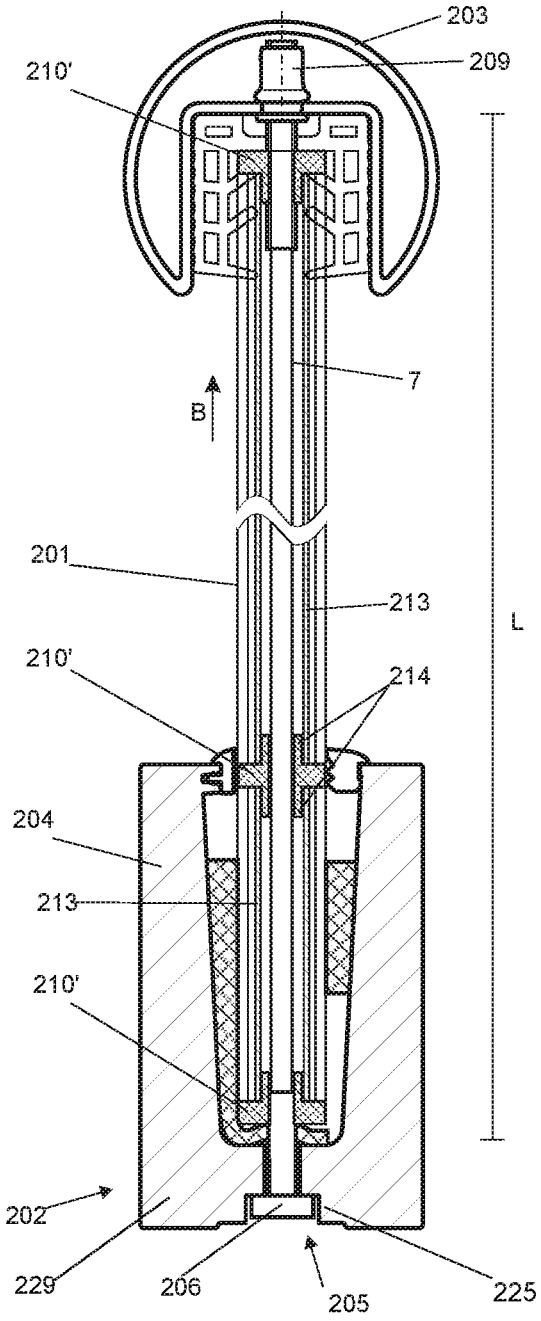
FIG. 4 shows a third possible sectional view, alternative to the embodiments of FIG. 2 and of FIG. 3, of a third embodiment along the section A-A indicated in FIG. 1.

FIG. 4 shows a further alternative embodiment of the railing system, which can be employed, in particular, in a railing to be laterally attached to a balustrade or a parapet (lateral assembly). Below, the differences from the embodiments represented in the previous figures are predominantly examined.

The securing element configured as a high-strength cable 107 engages via a securing anchor 106 in the lower, horizontal branch of the holding profile 102 of U-shaped cross section. To this effect, a passage opening 105 is made in the lower, horizontal branch of the holding profile 102. In the case of a lateral assembly, for which the embodiment represented in FIG. 4 is in particular provided, the securing anchor remains accessible from below. All the same, the embodiment represented in FIG. 4 is in principle also suitable for a vertical assembly.

Unlike, for instance, in the embodiment shown in FIG. 2, the securing element, via the passage opening 105 made in centered arrangement in the horizontal branch of the holding profile 102, is also held centered relative to the railing panel 101, so that the centering aid 110', which can nevertheless be seen from FIG. 4, at least for the centering of the securing element in relation to the railing panels 101 or the holding profile 102, would not be absolutely necessary.

All the same, FIG. 4 shows a plurality of centering aids 210', which in particular also serve to center a tubular sleeve 213 relative to the railing panels 201 and to the securing element. By means of one or two mutually opposite append ages 214, the tubular sleeves 213 are held in a defined position in relation to the neighboring structural parts, so that a visual satisfactory positioning of the tubular sleeves 213 in relation to the neighboring structural parts within the gap S (FIG. 1) between the railing panels 201 is obtained.

Moreover, the tubular sleeves conceal the securing elements guided therein and preferredly realized as wire cables, so that their working and structure cannot be divined from outside. Moreover, they additionally protect the securing element, and the system components cooperating therewith, from vandalism.

Of course, on the centering aid 210', instead of the appendages 214 shown in FIG. 4, also recesses into which the tubular sleeves 213 can be inserted for centering purposes can be provided. The cross-sectional shape of the tubular sleeves 213, and the thereto matched appendages 214 or recesses on the centering aids 210', is broadly freely selectable, so that, by means of the centering aids 210', for example also tubular sleeves of rectangular basic cross section can be positioned in the gap S (FIG. 1) between two railing panels 201 in defined and visually appealing position and permanently securely held.

Since the tubular sleeves are realized as metal or plastics tubes, within which the steel cable, which is preferredly used as part of the securing element, is guided, they help to lend a buckle resistance to the non-inherently buckle-resistant steel cable. For if the, on its own, non-buckle-resistant steel cable is guided within a tubular sleeve suitably matched to the diameter thereof over the broadly total inner system height L, the wire cable, despite its own lacking buckle resistance, can be guided within the tubular sleeve in a broadly buckle-resistant manner, so that, even after the fitting of the holding profiles 2 to the structural body and the preinstallation of the railing panels from above (counter to the tensile load direction B), it can be slid into the securing anchor 6 inserted previously from below into the holding profile 2.

REFERENCE SYMBOL LIST

1 railing panels
2 holding profile (bottom profile)
3 handrail profile (handrail tube)
4 side branch
5 passage opening
6 securing anchor
7 steel cable
9 blind rivet nut
10,10' centering aid
11 anchor bridge
12 pretensioning screw
13 tubular sleeve
14 appendages
S gap between two adjacent railing panels
B direction of load

The invention claimed is:

1. A railing system comprising:
a railing;
a railing panel frontage extending continuously along the course of the railing the railing panel frontage comprising a plurality of mutually adjacent railing panels vertically embedded with their lower marginal region in a holding profile fastened to a structural body or in a recess defined in a structural body;
a handrail profile mounted on an upper marginal region of the railing panel frontage; and
a securing element extending between the handrail profile and the structural body or the holding profile;
wherein the securing element connects the handrail profile to the structural body or the holding profile,
wherein the securing element is guided in one or more tubular sleeves.

2. The railing system as claimed in claim 1, wherein one or more centering aids, by means of which the one or more tubular sleeves are held over an inner system height in a defined position in relation to neighboring structural parts, are provided.

3. The railing system as claimed in claim 1, wherein one or more centering aids, by means of which a plurality of tubular sleeves are connected to one another over an inner system height, are provided.

4. A railing system comprising:
a railing;
a railing panel frontage extending continuously along the course of the railing the railing panel frontage comprising a plurality of mutually adjacent railing panels vertically embedded with their lower marginal region in a holding profile fastened to a structural body or in a recess defined in a structural body;
a handrail profile mounted on an upper marginal region of the railing panel frontage; and
a securing extending between the handrail profile and the structural body or the holding profile;
wherein the securing element connects the handrail profile to the structural body or the holding profile,
wherein on the holding profile is provided an anchoring point, at which, for the purpose of positive engagement of a securing anchor in the holding profile, an undercut acting in the direction of load is formed in a material region of the holding profile.

5. The railing system as claimed in claim 4 wherein the securing element is formed by a cable or a rod or a tube.

6. The railing system as claimed in claim 4, wherein, for the connection of the securing element to the handrail profile, the securing element engages positively in the handrail profile.

7. The railing system as claimed in claim 4, wherein, as the anchoring point for the securing anchor, a passage opening is provided through a material portion forming the holding profile.

8. The railing system as claimed in claim 7, wherein the passage opening is provided in the lower, horizontal branch of the holding profile facing toward the structural body given a correctly erected railing.

9. The railing system as claimed in claim 4, wherein the securing element extends within a gap between two adjacent railing panels.

10. The railing system as claimed in claim 4 wherein the anchor bridge is configured such that, in a first orientation, it can be introduced into the holding profile or the recess defined in the structural body and, in a second orientation, within the holding profile or the recess defined in the structural body, back-grips at least on one side a material portion, acting in the direction of load, of the holding profile or of the recess defined in the structural body.

11. The railing system as claimed in claim 4 wherein the holding profile is a bottom profile having a U-shaped receiving channel for receiving the lower marginal regions of the railing panels, the bottom profile being configured to fixedly anchored to a building structure.

12. The railing system as claimed in claim 4 wherein the railing panels form a continuous glass surface being interrupted by gaps with the handrail profile being a continuous handrail profile extending over the gaps.

13. The railing system as claimed in claim 4 wherein the holding profile is has a U-shaped receiving channel for receiving the lower marginal regions of the railing panels and the securing anchor includes an anchor bridge wedged within the receiving channel such that the anchor bridge back-grips on a first side a material region of the holding profile projecting inward within the receiving channel and is supported against the inner wall of the bottom profile on a second side.

14. A railing system comprising:

a railing;

a railing panel frontage extending continuously along the course of the railing the railing panel frontage comprising a plurality of mutually adjacent railing panels vertically embedded with their lower marginal region in a holding profile fastened to a structural body or in a recess defined in a structural body;

a handrail profile mounted on an upper marginal region of the railing panel frontage; and a securing element extending between the handrail profile and the structural body or the holding profile;

wherein the securing element connects the handrail profile to the structural body or the holding profile, wherein that end of the securing element which is facing toward the structural body or the holding profile is anchored directly in the structural body or in the holding profile, wherein that end of the securing element which is facing toward the holding profile is operatively connected to the holding profile via a securing anchor engaging in a holding profile, wherein the securing anchor comprises an anchor bridge, which is capable of wedging within the holding profile or the recess defined in the structural body, in the direction of load of the securing element.

15. The railing system as claimed in claim 14, wherein the anchor bridge is configured such that, in a first orientation, it can be introduced into the holding profile or the recess defined in the structural body and, in a second orientation, within the holding profile or the recess defined in the structural body, back-grips at least on one side a material portion, acting in the direction of load, of the holding profile or of the recess defined in the structural body.

16. The railing system as claimed in claim 15, wherein a centering element, by means of which the securing element is held centered in a gap existing between two adjacent railing panels, is provided.

17. The railing system as claimed in claim 16, wherein a pretensioning mechanism, by means of which that part of the securing element which extends between handrail profile and holding profile or the recess defined in the structural body can be set to pretensioned, is provided.

18. The railing system as claimed in claim 14 wherein the holding profile is has a U-shaped receiving channel for receiving the lower marginal regions of the railing panels and the securing anchor includes an anchor bridge wedged within the receiving channel such that the anchor bridge back-grips on a first side a material region of the holding profile projecting inward within the receiving channel and is supported against the inner wall of the bottom profile on a second side.

* * * * *